United States Patent [19]

Atwater

[11] 3,979,928

[45] Sept. 14, 1976

[54] HOSIERY-TYPE KNITTING MACHINES ADAPTED FOR THE PRODUCTION OF LARGE LOOSE STITCHES FROM HEAVY-DENIER YARN

[76] Inventor: Roy V. Atwater, P.O. Box 248, Yanceyville, N.C. 27379

[22] Filed: Feb. 26, 1975

[21] Appl. No.: 553,131

[52] U.S. Cl. ..... 66/107; 66/54; 66/125 B; 2/115; 66/176

[51] Int. Cl.[2] ..... D04B 15/06

[58] Field of Search ..... 66/107, 104, 125 B, 66/54, 176, 173, 175

[56] References Cited

UNITED STATES PATENTS

| | | | |
|---|---|---|---|
| 1,448,653 | 3/1923 | Bosworth | 66/107 |
| 2,143,444 | 1/1939 | Kesselman | 66/176 |
| 2,575,700 | 11/1951 | Artzt | 66/176 |
| 2,837,904 | 6/1958 | Scriggins | 66/176 |
| 2,919,567 | 1/1960 | Looper | 66/176 |
| 3,078,699 | 2/1963 | Huntley | 66/176 |
| 3,104,537 | 9/1963 | Fregeolle | 66/54 X |
| 3,195,147 | 7/1965 | Yamamura | 66/176 X |
| 3,290,694 | 12/1966 | Goodman | 66/176 X |
| 3,331,219 | 7/1967 | Brook | 66/107 X |
| 3,435,636 | 4/1969 | Linder | 66/107 X |

FOREIGN PATENTS OR APPLICATIONS

| | | | |
|---|---|---|---|
| 928,859 | 6/1963 | United Kingdom | 66/125 B |
| 1,230,084 | 4/1971 | United Kingdom | 66/107 |

*Primary Examiner*—Mervin Stein
*Assistant Examiner*—Andrew M. Falik
*Attorney, Agent, or Firm*—Robert Irving Williams

[57] ABSTRACT

Fine gauge knitting machines utilized in the production of hosiery and comprising needle cylinders three and three-quarter to four inches in diameter and carrying 300 to 469 needles are modified for the production of outerwear garments and the like knitted with relatively large loose loops by replacing the sinker caps thereof by sinker caps which are 0.060 to 0.100 of an inch less in interior diameter than those used in such machines for the production of hosiery, and replacing the sinker throw-in cam and the sinker throw-out cam by cams which differ from those used in the machine for the production of hosiery to use this additional space for sinker movement, by replacing the sinkers by sinkers having bottom legs 0.030 to 0.075 of an inch shorter than those used in corresponding conventional machines for the production of hosiery, and by replacing a stitch cam or cams by those which are 0.038 to 0.043 of an inch further withdrawn at the deeper operative surface thereof on a line such that the needles substantially maintain their vertical position until this line is reached and thereafter draw down the yarn rapidly to form a large stitch, and the throw-at plate by a plate which is 0.015 to 0.032 of an inch less thick than that of a corresponding hosiery machine. The tubular portions formed on such machines may be slit and joined to each other to provide the desired garments. Latch needles may be effectively used. In certain instances modification of the latch ring may be provided in connection with means for controlling the transfer stitches to turn cuffs and waistbands. Outerwear having desirable characteristics is provided.

6 Claims, 29 Drawing Figures

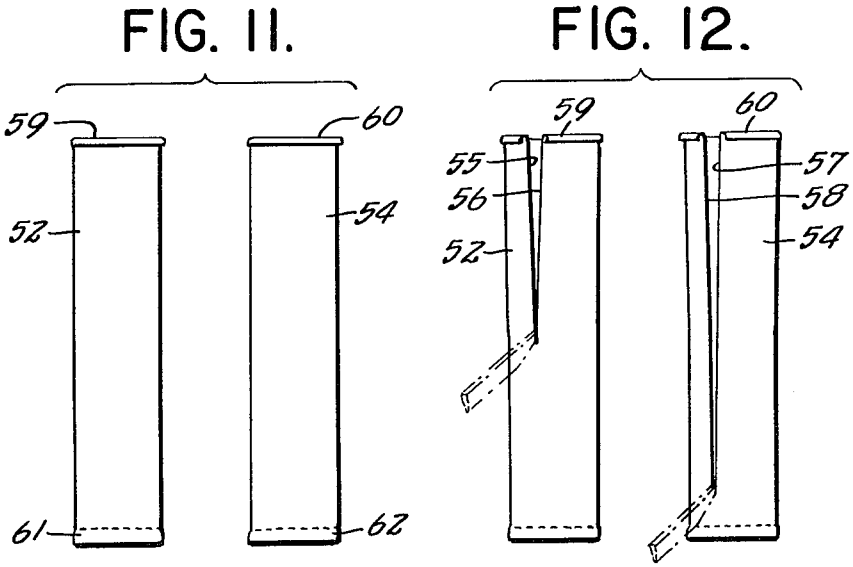
FIG. 12.
FIG. 11.
59
52
61
60
54
62
55
56
57
58
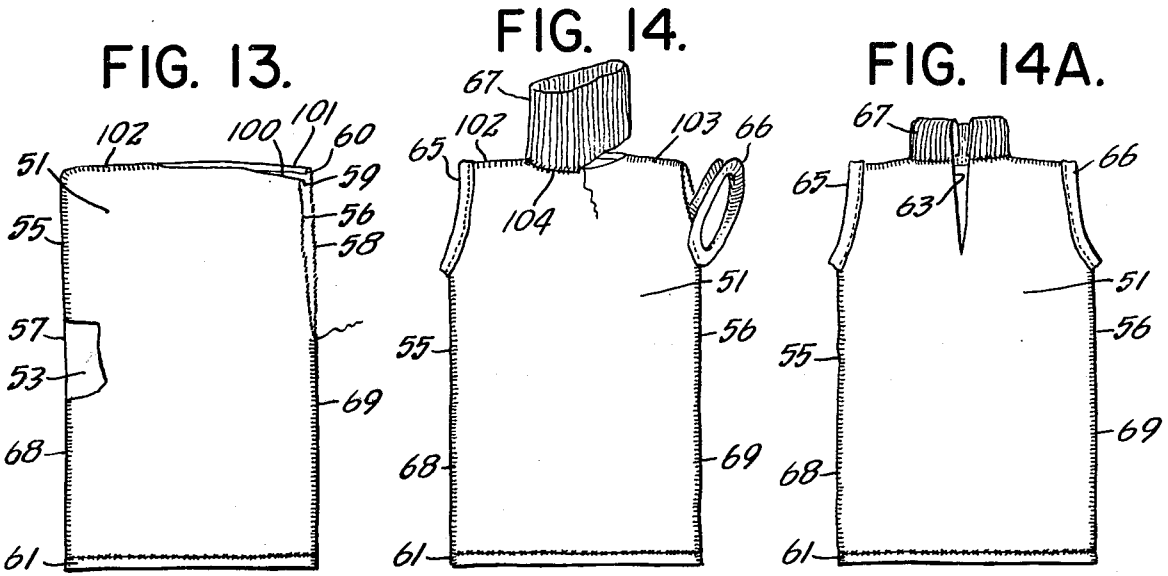
FIG. 14A.
FIG. 14.
FIG. 13.
51
55
56
57
58
59
60
61
63
65
66
67
68
69
100
101
102
103
104
53
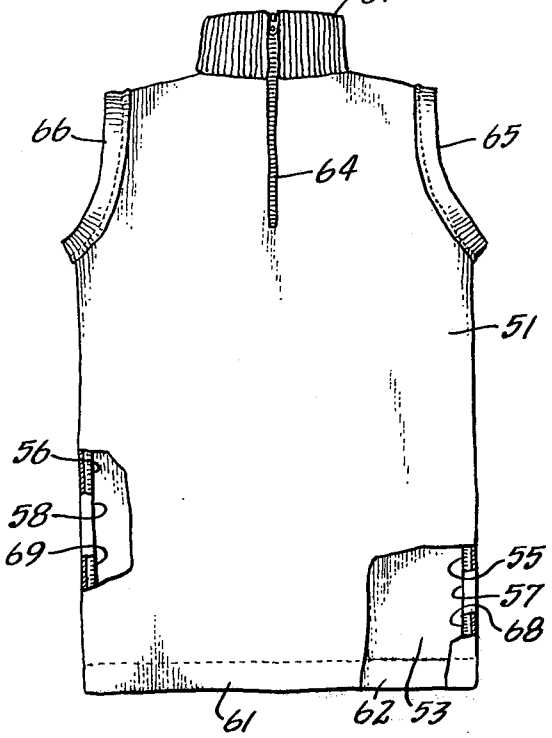
FIG. 10.
51
53
55
56
57
58
61
62
64
65
66
67
68
69

HOSIERY-TYPE KNITTING MACHINES ADAPTED FOR THE PRODUCTION OF LARGE LOOSE STITCHES FROM HEAVY-DENIER YARN

BACKGROUND OF THE INVENTION

1. Field of the Invention

The demand for different kinds of knitwear not only varies seasonally, but also varies from time to time in accordance of the popularity of particular types of garments. The meeting of maximum demands for hosiery and for outergarments has in the past required that a knitting mill have a sufficient number of hosiery machines to meet peak demands for hosiery and a sufficient number of very different larger machines to meet the peak demands for outerwear. Since these peaks seldom coincide, a highly expensive tie-up of capital is required to insure meeting each of these separate peaks, whereas machines of one type or the other are almost always lying idle.

DESCRIPTION OF THE PRIOR ART

The knitting of outerwear and other fabric with large and loose loops has been common for many years, but the adaptation of circular fine gauge hosiery type machines to the production of such fabric so that the use of the machine may be reversed from a hosiery machine to a machine for making outerwear and the like, and the reversal of the latter to one for making hosiery was, in so far as is known, not accomplished prior to the present invention. It is to be noted that, if heavy yarn is used on an ordinary hosiery machine, the fabric will have extremely small, tight loops with very small horizontal stretch as needed for outer garments.

SUMMARY OF THE INVENTION

I have now found that by making minor reversible modifications (i.e. by replacement of removable machine parts by modified, removable members) in hosiery machines and operations, these may be adapted to the production of outerwear, thus utilizing the hosiery machines for the production of outerwear in times of slack hosiery demand. In times of peak hosiery demand these machines may be restored to the production of hosiery. In this manner a smaller number of the larger outerwear machines are required to meet peak outerwear demands.

In accordance with the present invention, heavy denier yarns suitable for outerwear garments can be knitted with large loose loops suitable for use for outerwear garments when slit vertically and sewn.

In carrying out this invention, the operations of the needles, sinkers, and in certain instances other elements are adjusted to permit the handling of the longer stitches and/or heavier yarns required by outerwear garments. Two tubular portions thus knitted are slit vertically and sewn together edge-to-edge, and other operations performed as may be desired in particular cases. In cases where a waistband is required this may be turned on the knitting machine and does not require additional sewing. Sleeves may be made by cutting and tapering additional tubes, which may be formed with turned-over cuffs, and the cut edges of each sleeve sewn and the sleeve sewn to the body portion. A long sleeve or a short sleeve garment may be provided, if and as desired. The sides may be seamed up, and the waistband or other cuff or hem for the body of the garment being turned on the knitting machine, a collar sewed on, or a zipper sewed in place, or other modification formed as may be desired. The garment may be placed or stretched on forms, and subjected to live steam to stretch and set the fabric, where necessary.

Upper garments, leotards, sweaters, trunks and garments as set forth in FIG. 5 of the Matthews et al U.S. Pat. No. 3,824,812 may be formed, among others.

Leg portions may be provided by lengthening the tubular portions forming the front and back, and by additionally slitting the garment upwardly so that trunk, leotard, or other legs may be formed by two opposite seams on each leg. Steaming on a form will desirably follow to stretch and hold fabric portions to a greater width or a desired shape.

BRIEF DESCRIPTION OF THE DRAWINGS

FIG. 10 shows a front view of a sleeveless top garment embodying the invention and formed in accordance with the invention, partly broken away.

FIG. 11 shows diagrammatically two knitted cylindrical portions of relatively small diameter having turned waistband and neck portions;

FIG. 12 shows diagrammatically the slitting of these two lengths of tubular fabric;

FIG. 13 shows diagrammatically the seaming of the edges of the major slits in the fabric for joining them into a double-diameter garment as shown in FIG. 10;

FIG. 14 shows diagrammatically the sewing on of the arm hole portions after cutting, and the collar portion;

FIG. 14A shows a slit for the addition of the zipper;

DESCRIPTION OF THE PREFERRED EMBODIMENTS

One type of modified hosiery machine embodying the invention is illustrated, and certain steps of a process embodying the invention is illustrated in connection therewith.

Figure 1:
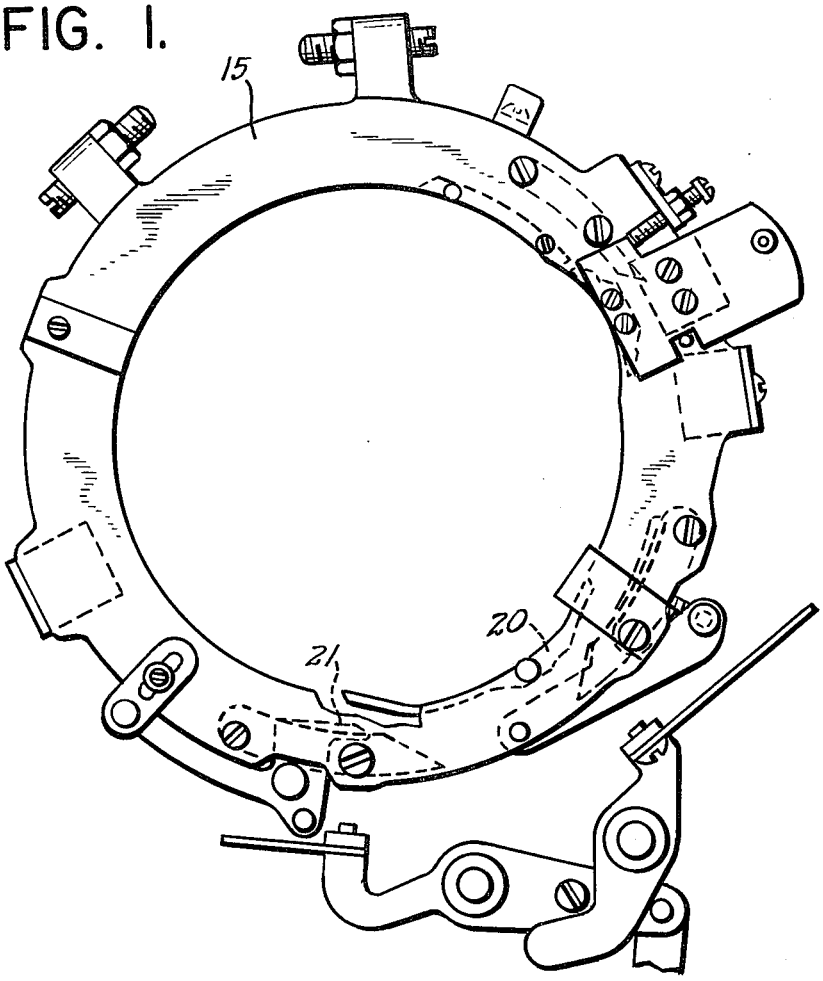
FIG. 1 is a plan view of the sinker cap assembly and linkage of one form of machine modified in accordance with the invention.
Figure 5:
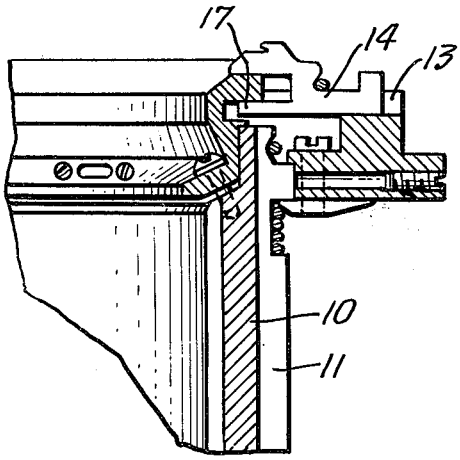
FIG. 5 is a sectional view through a portion of the needle and sinker beds.

The exemplified machine comprises a needle cylinder 10 (shown in FIG. 5) having needle slots 11 therein for the reception of needles 12 (FIG. 7), and (FIG. 5) sinker slots 13 carrying sinkers 14. A sinker cap assembly 15 (FIG. 1) operates the sinkers, and a needle cam arrangement 16 (FIG. 8) is provided for operating the needles. In the present instance the cylinder rotates and the cam arrangements are stationary.

Figure 9:
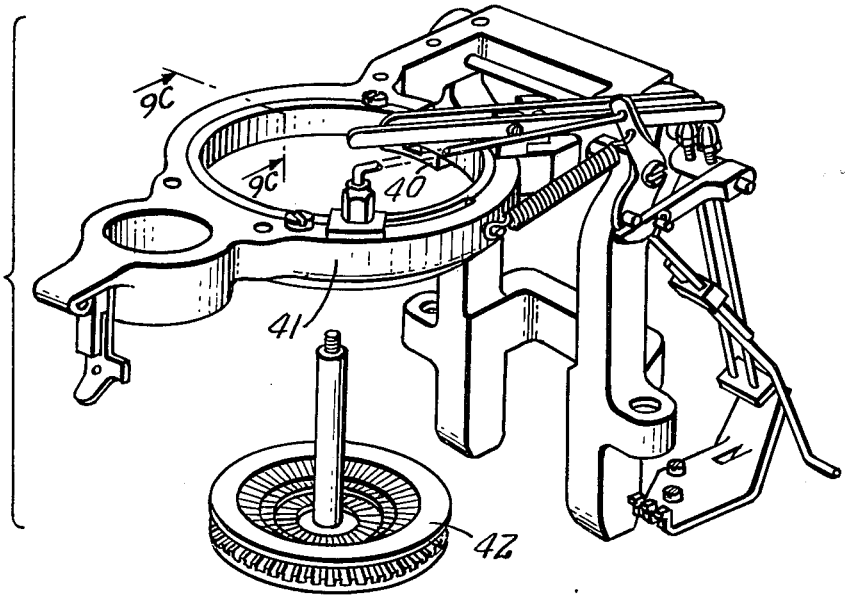
FIG. 9 is an exploded perspective view of a latch-ring-assembly and dial assembly showing the modified throat plate, an optionally modified latch ring, and a welt-turning dial.
Figure 9A:
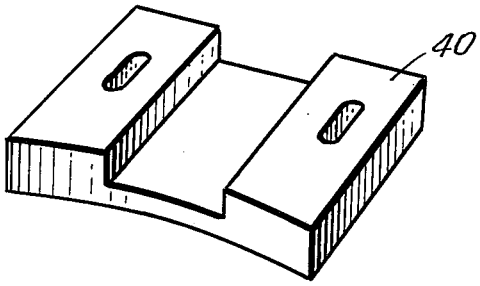
FIG. 9A shows the modified throat plate enlarged.
Figure 9B:
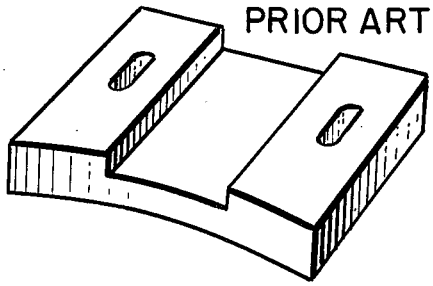
FIG. 9B. PRIOR ART
FIG. 9B shows an unmodified throat plate similarly enlarged.
Figure 9C:
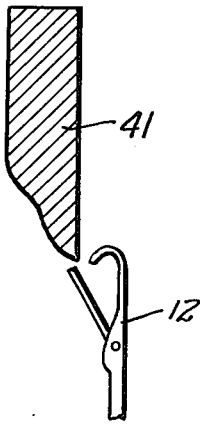
FIG. 9C shows the modified latch ring in section enlarged.
Figure 9D:
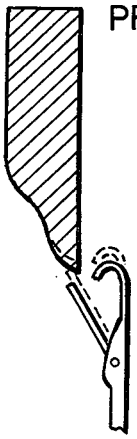
FIG. 9D. PRIOR ART
FIG. 9D shows in section an unmodified latch ring enlarged.

The particular hosiery machine exemplified is a two-feed Fidelity machine, and contains a pair of the yarn guide or throat plate and cap assemblies one of which is shown in FIG. 9.

Figure 2:
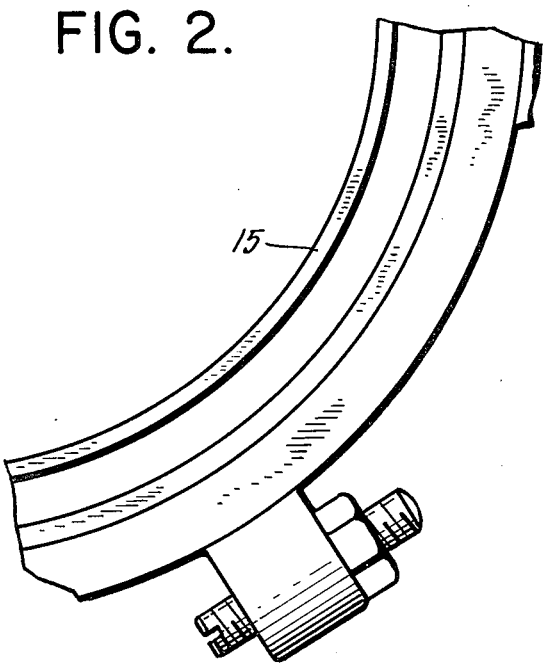
FIG. 2 is a large detail view of the sinker cap from below.
Figure 2A:
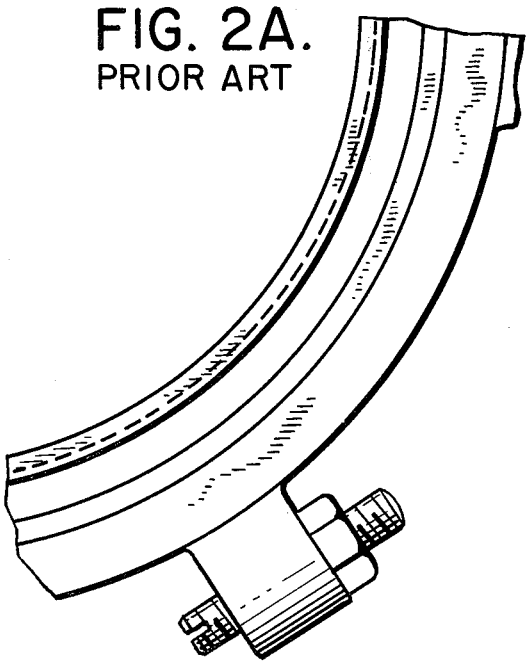
FIG. 2A. PRIOR ART
FIG. 2A shows for comparison a similar part of an unmodified machine as utilized for the production of hosiery.
Figure 3:
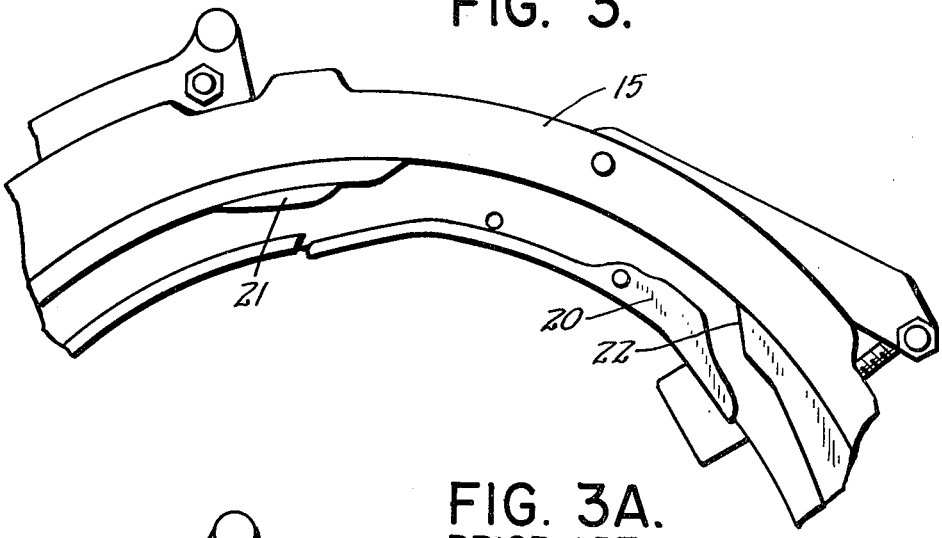
FIG. 3 is an enlarged view from below showing the sinker cams of the modified machine.
Figure 3A:
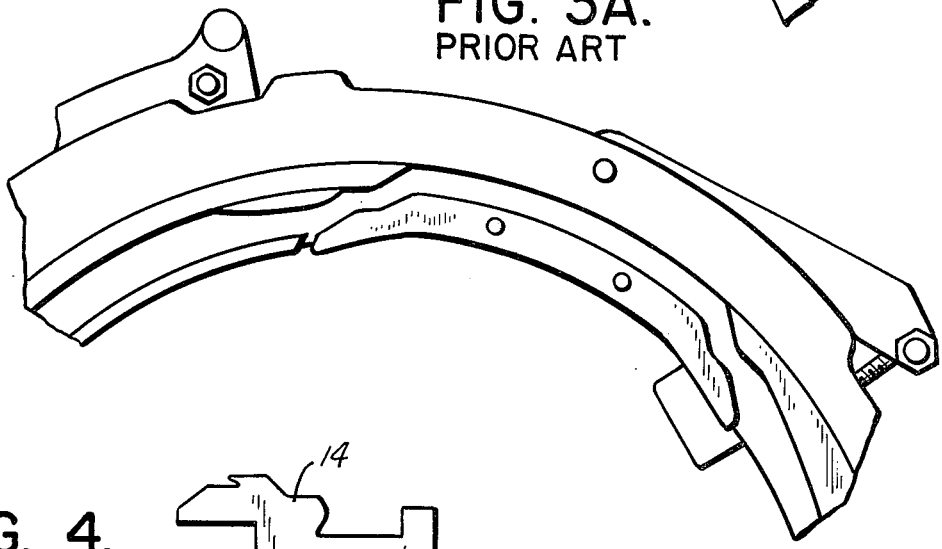
FIG. 3A. PRIOR ART
FIG. 3A is a similar view showing sinker cams as used for the knitting of hosiery.
Figure 4:
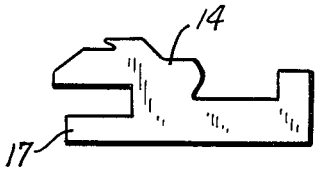
FIG. 4 is a detail view (not to scale) of the modified sinker.
Figure 4A:
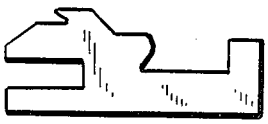
FIG. 4A. PRIOR ART
FIG. 4A shows the sinker as used for the manufacture of hosiery.

The sinkers (FIG. 4) are formed with sinker-legs 17 which are 0.053 in. shorter than those in the corresponding Fidelity hosiery machine (i.e. 0.985 of an inch). The sinkers are operated by the sinker cap 15 (FIG. 3) which is stationary (as is the needle cam arrangement) in the present instance, and which operates the rotating row of sinkers through the medium of a sinker throw-out cam 20, a sinker presser cam 21, and a sinker throw-in cam 22. The sinker cap (FIG. 2) is reduced in width .040' at its interior with respect to those in corresponding hosiery machines (with that much material removed from the inside edge giving an interior diameter reduced 0.080 of an inch or a diameter of 4.795 of an inch.) to allow the sinkers to advance further between the needles to form a bigger loop and a looser fabric; and the cam arrangements are adjusted to accommodate the additional movement permitted by this modification.

Figure 6:
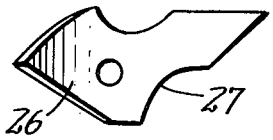
FIG. 6 shows the modified stitch cam.
Figure 6A:
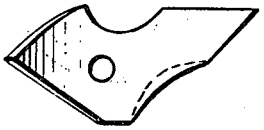
FIG. 6A. PRIOR ART
FIG. 6A shows the stitch cam as used for the manufacture of hosiery.
Figure 7:
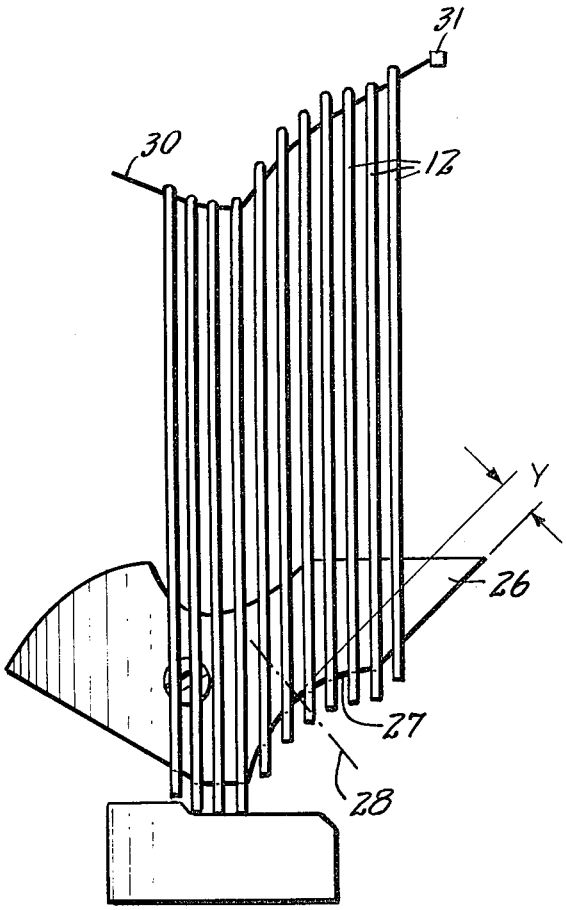
FIG. 7 shows on an enlarged scale the operation of the needles by the modified stitch cam.
Figure 7A:
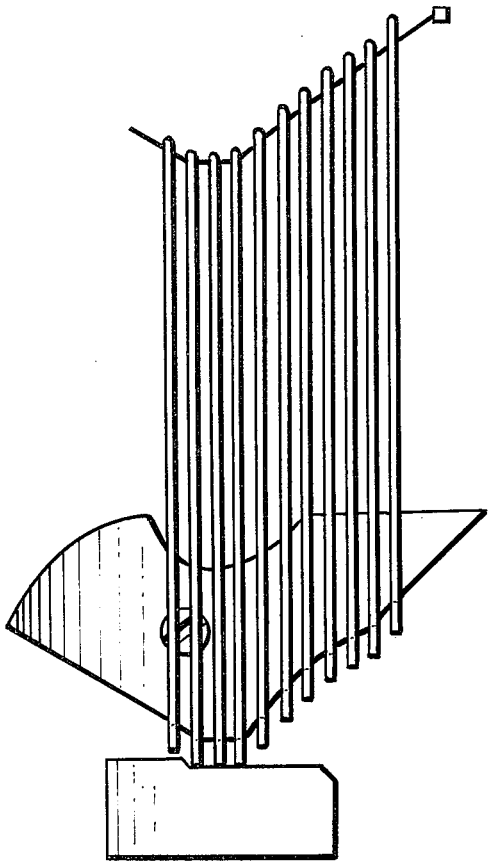
FIG. 7A. PRIOR ART
FIG. 7A shows the operation of an unmodified stitch cam.
Figure 8:
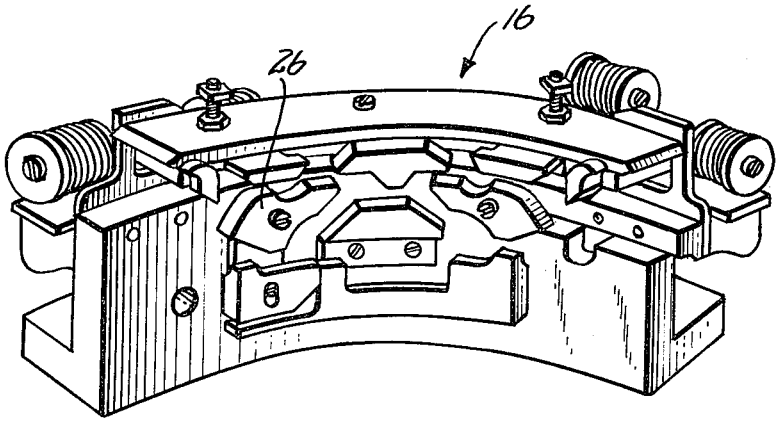
FIG. 8 shows a portion of the interior of the stitch cam assembly showing the position of the stitch cam of FIG. 6 in relation to the other cams.
Figure 9E:
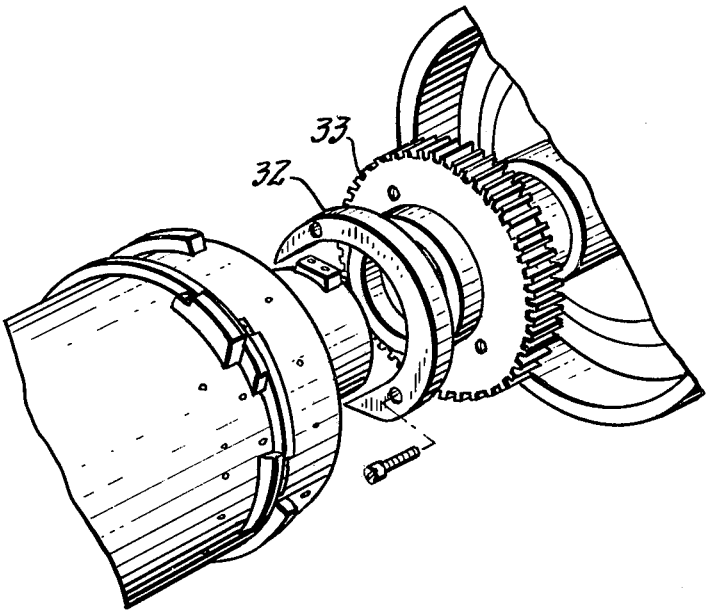
FIG. 9E is a detail view of the cam drum assembly showing the fashioning or stitch graduation cam.

The needle cam ring arrangement 16 (FIG. 8) includes the usual cams (serving their usual purposes) among which is a specially-designed stitch cam 26 which is also shown in FIGS. 6 and 7. The camming surface 27 (instead of slanting downwardly in a substantially straight line as shown in FIGS. 6A and 7A) are each formed as a concavity the upper right hand portion of which is substantially horizontal. At a line 28, 0.040 of an inch has been cut off from the normal cam (0.320 of an inch from a diagonal extending directly across the concavity in the cam), and the surface 27 turns downwardly to descend rapidly to its lowest point. In this manner yarn 30 from each yarn guide 31 is loose with respect in a few needles (the third, fourth, fifth and sixth from the right in FIG. 7) so that it can be drawn down without any pressure by the following needles (the seventh and eighth from the right in FIG. 7) to draw long, loose loops. Normally, in hosiery machines the stitch size is controlled by an eccentric fashioning cam that raises and lowers the cylinders, such a cam being shown at 32 in FIG. 9E as is also the ratchet 33 which drives it. Ordinarily, in hosiery, the stitch starts off loose and gradually tightens. For purposes of the present invention, however, the tubes knitted may start off with a somewhat tighter stitch graduating to a very loose stitch as the shoulder area is approached.

The parts shown in FIG. 9 comprise the latch ring and gap closer assembly in which the parts are of the usual character in the hosiery machine and serve their usual purposes with the exception of the throat plate 40 and the latch ring 41. The throat plate has .026 of an inch less thickness than that of a corresponding hosiery machine (a thickness of about 0.032 of an inch) in order to allow yarn to be fed from the yarn fingers to the needle hooks at a closer angle and also to change the angle of the yarn lead to the needles. The machine, in the present instance, includes a dial 42 for turning welts; and from 0.020 to 0.050 of an inch is removed from the bottom of the latch ring to provide clearance. This is necessary, in some instances, in order for effective operability in Fidelity, Textile Mark III, Scott and Williams and other machines having means to transfer stitches to turn cuffs and waistbands because the cylinder is raised extremely high to form the loose stitch required by outer garments; but in various other instances this modification may be omitted. A fashioning cam 32 is provided.

It has been found that effective results can be secured when from 0.030 to 0.050 of an inch is removed from the sinker cap of a hosiery machine (reducing its interior diameter by .060 of an inch .100 of an inch so as to have an interior diameter of 4.815 to 4.775 inches), when 0.030 to 0.075 is removed from the bottom legs of the sinkers, when 0.038 to 0.043 is removed from the stitch cam (to be 0.322 to 0.317 of an inch from a diagonal extending directly across the concavity in the cam), and when 0.015 to 0.030 is removed from the throat plate (so that it will have a thickness of from 0.028 to 0.043 of an inch).

In FIG. 10 there is shown one type of garment formed in accordance with and embodying the invention. It is in the form of an upper garment comprising a front 51 formed from a tube 52 knitted as above indicated, and shown in FIG. 11, and a back 53 similarly knitted as shown in FIG. 11 at 54. The tubes 52, and 54 are each slit longitudinally as shown in FIG. 12 to provide edges 55 and 56 on the front and 57 to 58 on the back. The edges 55 and 57 are seamed together, and the edges 56 and 58 are seamed together.

The front and back pieces 51 and 53 have been knitted with neck portions 59 and 60 and waistband portions 61 and 62, respectively, and these are united by the seaming to form a continuous top opening and waistband. Edge portions are seamed as at 102 and similar edge portions 100 and 101 are seamed as at 103. The front portion 51 is further slit downwardly to a certain extent as shown at 63 in FIG. 14A, and a zipper 64 sewn in.

Armhole cuffs 65 and 66 after suitable cutting of the armholes are sewn on, and a collar 67 is sewn on as at 104. The seaming at the sides of the garment is indicated at 68 and 69.

Figure 16:
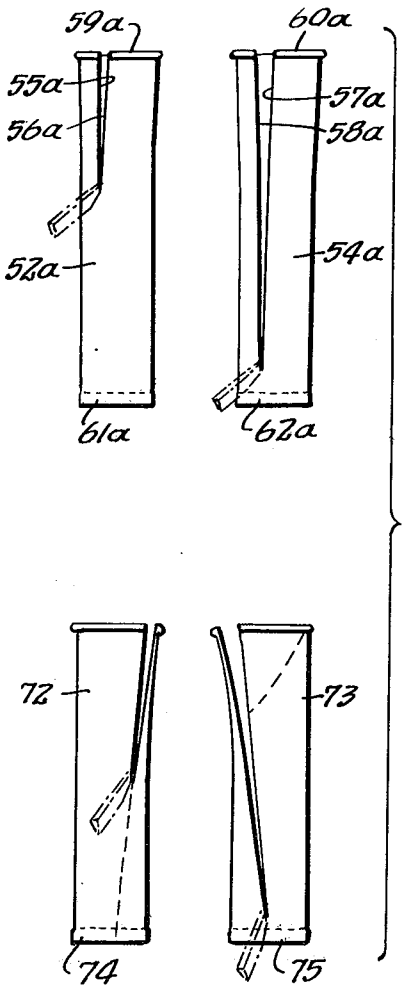
FIG. 16 shows a slitting of two cylinders similar to those of FIG. 10 and also shows cutting and tapering of two sleeve cylinders to be seamed into the two arm holes in the sides of the garment.
Figure 15:
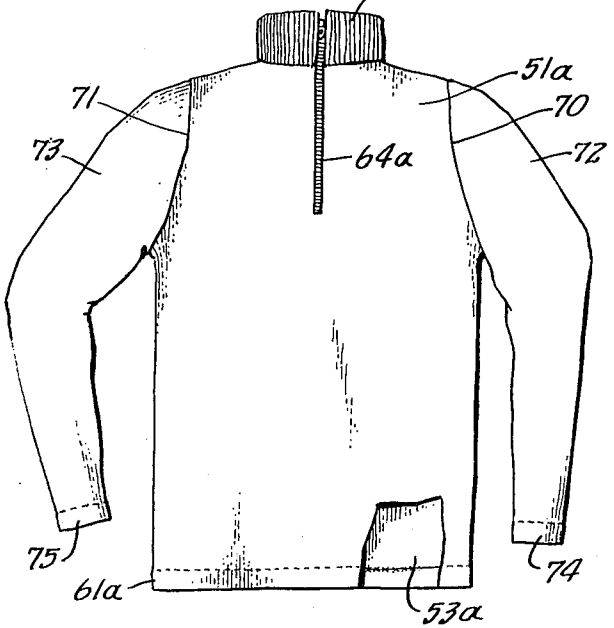
FIG. 15 shows a long sleeve top garment embodying the invention.
Figure 17:
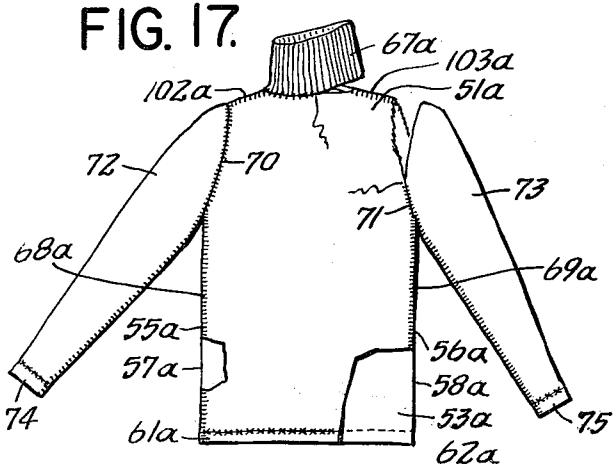
FIG. 17 shows the seaming of the parts together.

The garment of FIG. 15 is similar. Similar parts are indicated by similar reference numerals to which the subscript *a* is appended. Instead of armhole cuffs, there are seamed at 70 and 71, to armhole openings, sleeves 72 and 73 each formed on a hosiery machine similar to that shown but with somewhat tighter stitches and carrying turned-over cuffs 74 and 75. The sleeves are formed by cutting and tapering tubes as indicated in FIG. 16. The use of sleeves otherwise formed is not, of course, excluded from the broader aspects of the present invention.

Figure 18:
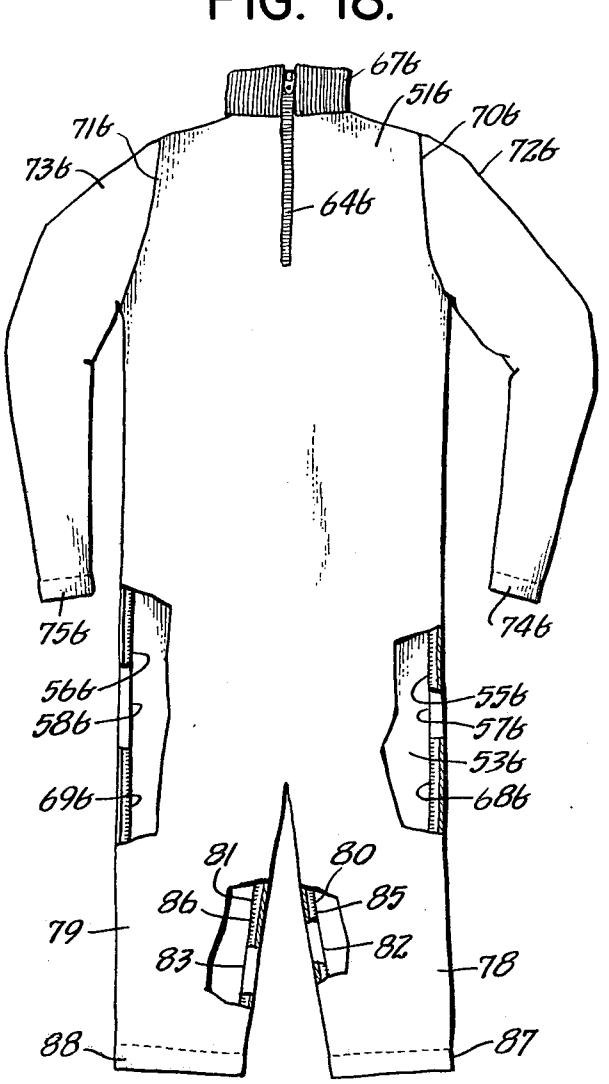
FIG. 18 shows a body garment having leg portions.

The garment of FIG. 18 is similar to the garment of FIG. 15, similar parts being indicated by similar reference numerals to which the subscript *b* is appended. Instead of a waistband, the tubes extend downwardly far enough to provide leg portions 78 and 79; and, besides being slit to provide edges 55*b*, 56*b*, 57*b*, and 58*b*, the tubes 51*b* and 53*b* are slit upwardly to a suitable extent to provide edges 80 and 81 on one tube opposite edges 82 and 83 on the other tube, so that the edges 80 and 82 may be seamed as at 85 and the edges 81 and 83 may be seamed as at 86 to provide seams 85 and 86 at the inside of the leg portions to match the seams 68*b* and 69*b* at the outside portion of the leg and body portions. As exemplified, turned-over cuffs 87 and 88 are provided just above the knee at the bottom of the leg portions.

After the garment has been assembled it may be stretched on a large open frame and subjected to live steam as in a Sussman pressing machine to smooth out any wrinkled fabric, and may then be stretched on open-wire forms and placed on flat trays and pushed into an autoclave chamber where vacuum is drawn and live steam entered into the vessel as at 28 pounds pressure which is maintained for twenty minutes at 270°F. This imparts a permanent set to the fabric and holds the fabric out to the shape of the form so that the flat width of the garment is increased where necessary.

I claim:

1. A circular knitting machine comprising a hosiery-machine needle cylinder from 3¾ to 4 inches in diameter and carrying 300 to 469 needles, and adapted for the production of circular knitting slittable and joinable in the formation of outer garments and the like containing larger and looser knitted loops than those knitted by a corresponding hosiery machine and a sinker cap 0.060 to 0.100 of an inch less in diameter at its interior than that used in a corresponding hosiery machine, and sinker throw-in and sinker throw-out cams differing from those used in a corresponding hosiery machine to use this additional space for sinker movement, sinkers having bottom legs 0.030 to 0.075 of an inch shorter than those in a corresponding hosiery machine, cam arrangements including a stitch cam or cams which are 0.038 to 0.043 of an inch further withdrawn at the operative surface thereof than on those in a corresponding hosiery machine on a line such that the needles substantially maintain their vertical position until this line is reached and thereafter draw down the yarn rapidly to form a long stitch, and a throat plate from 0.015 to 0.030 of an inch less thick than that of a corresponding hosiery machine.

2. A machine as in claim 1 wherein the machine includes welt-turning means, and the bottom of the latch ring is from 0.020 to 0.050 inches/higher than in a corresponding hosiery machine.

3. A circular knitting machine comprising a hosiery-machine needle cylinder from three and three-fourths to four inches in diameter and carrying 300 to 469 needles, and adapted for the production of circular knitting slittable and joinable in the formation of outer garments and the like containing larger and looser knitted loops than those knitted by a corresponding hosiery machine and a sinker cap which is about 0.080 of an inch less in diameter at its interior than used in a corresponding hosiery machine, and sinker throw-in cam and sinker throw-out cams differ from those used in a corresponding hosiery machine to use this additional space for sinker movement, sinkers having bottom legs which are about 0.053 of an inch shorter than those in a corresponding hosiery machine, cam arrangements including a stitch cam or cams which are about .040 of an inch further withdrawn at the operative surface thereof on a line such that the needles substantially maintain their vertical position until this line is reached and thereafter draw down the yarn rapidly to form a long stitch, and a throat plate which is about 0.026 of an inch less thick than that of a corresponding hosiery machine.

4. A circular knitting machine comprising a needle cylinder from three and three-fourths to four inches in diameter carrying 300 to 469 needles, sinkers, and cam arrangements, and adapted for the production of circularly knitted fabric slittable and joinable in the formation of outer garments and comprising a removable sinker cap having an interior diameter of from 4.775 to 4.815 inches and a removable sinker throw-in cam and a removable sinker throw-out cam adapted to use this full space for sinker movement, sinkers having bottom legs 1.008 to 0.963 of an inch in length, and a removable concave stitch cam or cams withdrawn 0.322 to 0.317 of an inch from a diagonal extending directly across the concavity in the cam and withdrawn on a line such that the needles substantially maintain their vertical position until this line is reached and thereafter draw down the yarn rapidly to form a long stitch, and having a removable throat plate with a thickness from 0.043 to 0.028 of an inch.

5. A circular knitting machine comprising a needle cylinder from three and three-fourths to four inches in diameter carrying 300 to 469 needles, sinkers, and cam arrangements, and adapted for the production of circularly knitted fabric slittable and joinable in the formation of outer garments and comprising a removable sinker cap having an interior diameter of about 4.795 inches and a removable sinker throw-in cam and a removable sinker throw-out cam adapted to use this full space for sinker movement, removable sinkers having bottom legs about 0.985 of an inch in length, and a removable concave stitch cam or cams withdrawn about 0.320 of an inch from a diagonal extending directly across the concavity in the cam and withdrawn on a line such that the needles substantially maintain their vertical position until this line is reached and thereafter draw down the yarn rapidly to form a long stitch, and having a removable throat plate with a thickness of about 0.032 of an inch.

6. A circular knitting machine comprising a needle cylinder from three and three-fourths to four inches in diameter carrying 300 to 469 needles, sinkers, and cam arrangements, and adapted for the production of circularly knitted fabric slittable and joinable in the formation of outer garments and comprising a sinker cap having an interior diameter of from 4.875 to 4.775 inches and a sinker throw-in cam and a sinker throw-out cam adapted to use this full space for sinker movement, sinkers having bottom legs 1.008 to 0.953 of an inch in length, and a concave stitch cam or cams from withdrawn .360 to .317 of an inch from a diagonal extending across the concavity of the cam on a line such that the needles substantially maintain their vertical position until this line is reached and thereafter draw down the yarn rapidly to form a long stitch, and having a throat plate with a thickness from 0.043 to 0.028 of an inch.

* * * * *